US008793848B2

(12) United States Patent
Reutter

(10) Patent No.: US 8,793,848 B2
(45) Date of Patent: Aug. 5, 2014

(54) DEVICE FOR NEEDLING A FIBROUS WEB

(75) Inventor: Tilman Reutter, Stolpe (DE)

(73) Assignee: Hi Tech Textile Holding GmbH, Leonding (AT)

( * ) Notice: Subject to any disclaimer, the term of this patent is extended or adjusted under 35 U.S.C. 154(b) by 209 days.

(21) Appl. No.: 13/394,980

(22) PCT Filed: Oct. 27, 2009

(86) PCT No.: PCT/EP2009/064134

§ 371 (c)(1),
(2), (4) Date: Mar. 8, 2012

(87) PCT Pub. No.: WO2011/029487

PCT Pub. Date: Mar. 17, 2011

(65) Prior Publication Data

US 2012/0167361 A1 Jul. 5, 2012

(30) Foreign Application Priority Data

Sep. 9, 2009 (DE) ..... 10 2009 040 858

(51) Int. Cl.
*D04H 18/00* (2012.01)
*D04H 18/02* (2012.01)

(52) U.S. Cl.
CPC ..... *D04H 18/02* (2013.01)
USPC ..... 28/107; 28/114

(58) Field of Classification Search
CPC ..... D04H 18/02
USPC ..... 28/107, 114, 113, 115, 112, 108, 109, 28/110, 111
See application file for complete search history.

(56) References Cited

U.S. PATENT DOCUMENTS

| | | | | | |
|---|---|---|---|---|---|
| 5,502,879 | A * | 4/1996 | Rinder | 28/115 |
| 5,548,881 | A * | 8/1996 | Ludwig | 28/114 |
| 5,732,453 | A * | 3/1998 | Dilo et al. | 28/114 |
| 6,161,269 | A * | 12/2000 | Dilo et al. | 28/114 |
| 6,266,856 | B1 * | 7/2001 | Fehrer et al. | 28/107 |
| 2003/0041424 | A1 * | 3/2003 | Legl et al. | 28/107 |
| 2003/0074773 | A1 * | 4/2003 | Legl et al. | 28/107 |
| 2005/0217093 | A1 * | 10/2005 | Muller | 28/107 |
| 2007/0006432 | A1 | 1/2007 | Noel et al. | |

(Continued)

FOREIGN PATENT DOCUMENTS

| | | |
|---|---|---|
| DE | 197 30 532 A1 | 1/1999 |
| DE | 10 2005 012 265 A1 | 10/2005 |

(Continued)

*Primary Examiner* — Amy Vanatta
(74) *Attorney, Agent, or Firm* — McGlew and Tuttle, P.C.

(57) ABSTRACT

A device for needling a fibrous web includes a needle bar. The needle bar carries a needle board having a plurality of needles and is guided by a bar carrier that is driven in an oscillating manner with superimposed horizontal and vertical motion via a crank drive. A phase-adjusting device adjusts a phase position of a crankshaft of the crank drive. The motion of the bar carrier is guided by a guiding device. To absorb inertial forces in the horizontal direction on the needle bar at large phase angles and to guarantee the mobility of the needle bar, the guiding device is formed by one or more guiding rods, which are connected to the bar carrier via a swivel joint. The driven needle bar is guided by the guide rods at the phase angle set by the phase-adjusting device in the angle range of 0 to 30 DEG.

15 Claims, 6 Drawing Sheets

(56) References Cited

U.S. PATENT DOCUMENTS

| | | | | |
|---|---|---|---|---|
| 2009/0119894 | A1* | 5/2009 | Reutter et al. | 28/114 |
| 2010/0242240 | A1* | 9/2010 | Reutter et al. | 28/107 |
| 2010/0306978 | A1* | 12/2010 | Reutter et al. | 28/107 |
| 2011/0179611 | A1* | 7/2011 | Reutter et al. | 28/107 |

FOREIGN PATENT DOCUMENTS

| | | | |
|---|---|---|---|
| EP | 1 939 343 | A2 | 7/2008 |
| WO | WO 2007/134731 | * | 11/2007 |
| WO | 2009/019111 | A1 | 2/2009 |

* cited by examiner

DEVICE FOR NEEDLING A FIBROUS WEB

CROSS REFERENCE TO RELATED APPLICATIONS

This application is a United States National Phase application of International Application PCT/EP2009/064134 and claims the benefit of priority under 35 U.S.C. §119 of German Patent Application DE 10 2009 040 858.4 filed Sep. 9, 2009, the entire contents of which are incorporated herein by reference.

FIELD OF THE INVENTION

The present invention pertains to a device for needling a fibrous web with a oscillating driven needle bar, which has on an underside a needle board with a plurality of needles, with a movable bar carrier for holding the needle bar, with a crankshaft assembly for the oscillating motion of the bar carrier, which has at least two connecting rods connected to the bar carrier and two driven eccentric shafts or two driven crankshafts, with a phase-adjustment for adjusting a phase angle at one of the two eccentric shafts or crankshafts and with a guide acting on the bar carrier for guiding the needle bar during the oscillating motion.

BACKGROUND OF THE INVENTION

A device of this type is known from DE 10 2005 012 265 A1.

The prior-art device is used for bonding and structuring fiber layers. For this purpose, a fibrous web is pierced with a plurality of needles, which are guided in an oscillating motion. In the process, the needles are thus guided with an oscillating vertical motion in order to bond the fibrous material in the fibrous web. In this process, the fibrous web is constantly moved forwards with a feed, which is preferably performed by rollers. Since the needles are not smooth, but are provided with barbs open in the puncture direction, individual fibers are grasped during the puncturing and reoriented within the fiber layer. Consequently, a felting and bonding effect is achieved. To not obtain any undesired deformations that lead, for example, to a drawing or a slot formation in the needled material during the puncturing of the needles in the fibrous web because of the feed of the fibrous web, the needles are guided with superimposed horizontal motion, which takes place superimposed on the vertical motion.

In the prior-art device, both the vertical motion and horizontal motion of the needle bar are initiated by means of a crankshaft assembly at the needle bar. The crankshaft assembly has two crank drives with two driven crankshafts for this purpose. The crankshafts are designed as adjustable in their phase positions by means of a phase-adjustment means. Depending on the phase position of the crankshafts to one another, an ellipse-like pattern of motion, in which the oscillating motion of the needle bar is carried out, is produced. To obtain an as stable as possible puncturing of the needles in the fibrous web, a guide means which acts on the needle bar is additionally provided. However, both the vertical motions of the needle bar and the horizontal motions of the needle bar should be performed unobstructed. In the prior-art device, the guide means is formed by a guide rod which is guided in a guide sleeve held on a machine frame. The guide sleeve is held on the machine frame pivotably via a pivot bearing, such that, depending on the phase position of the crankshafts, an oblique positioning of the bar carrier via the pivot bearing of the guide means is possible. In this case, during the drive of the bar carrier, the guide path performed by the bar carrier is essentially dependent due to the fixed position of the pivot bearing of the guide means. Thus, only very small horizontal strokes can be made by a phase adjustment of the crankshafts.

Further, in the prior-art device, the problem arises that with increasing degree of phase adjustment between the two crankshafts, the free forces due to inertia and moments of inertia increase and lead in the extreme case to increased vibrations in the machine frame. Horizontally directed forces due to inertia are especially produced by the horizontal motion component of the needle bar, which can be balanced only insufficiently by means of a mass balancing at the crankshafts. In this respect, the prior-art device is only suitable for performing a horizontal motion of the needle bar within narrow limits.

However, such devices, in which the vertical motion of the needle bar is performed by a vertical drive and the horizontal motion is performed by a separate horizontal drive, are basically known in the state of the art. Such a device is known, for example, from DE 197 30 532 A1. The separate horizontal drive of the prior-art device makes possible even greater motion amplitudes, but with the drawback of complicated mechanisms, which limit the stroke frequency of the machine and with a high space requirement lead to large and heavy machine frames.

SUMMARY OF THE INVENTION

An object of the present invention is to provide a device for needling a fibrous web of the type in which the needle bar can be flexibly driven by means of a crankshaft assembly with superimposed vertical and horizontal motions.

Another goal of the present invention is to provide a device of this class for needling a fibrous web, in which the crankshaft assembly can be adjusted with simple means to vary the horizontal stroke of the machine during the operation within wide limits.

According to the invention, a device is provided for needling a fibrous web. The device comprises a needle bar with a needle board at an underside of the needle bar, the needle board having a plurality of needles a movable bar carrier holding the needle bar and a crankshaft assembly connected to the bar carrier and imparting an oscillating motion to the bar carrier. The crankshaft assembly comprises connecting rods connected to the bar carrier, one of driven eccentric shafts and driven crankshafts and a phase-adjustment means for adjusting a phase angle of one of the eccentric shafts relative to another of the eccentric shafts or for adjusting a phase angle of one of the crankshafts relative to another of the crankshafts in an angle range of 0° to 30°. A guide means is provided for acting on the bar carrier and for guiding the needle bar during the an oscillating motion. The guide comprises a guide rod and a swivel joint. The guide rod is connected to the bar carrier by the swivel joint with the needle bar guided by the guide in the phase angle range of 0° to 30°.

The present invention is characterized in that especially the forces due to inertia produced in the horizontal direction in a phase adjustment of the crankshafts can be absorbed directly at the needle bar, without the mobility of the needle bar being compromised. For this purpose, the guide means has one or more guide rods, which are connected to the needle bar by swivel joints. The forces due to inertia can thus be transmitted by pushing and pulling forces and supported opposite a machine frame. It has been shown that a maximum phase adjustment of a phase angle of 30° is thus possible between the crankshafts or the eccentric shafts. At larger phase angles, high vibration stresses due to the even greater forces due to inertia arise, such that the needle bar for guiding the needles in an elliptical path can be guided with the crankshaft assembly only with limited phase difference.

The present invention is also not suggested by the needle machine, in which the degree guide of the needle bar has a guide rod with steering gear, known from WO 2009/019111 A1. The prior-art needle machine has a vertical drive, by means of which the needle bar is driven to a vertical motion. In this case, a phase adjustment of the crankshafts is not provided, so that a complete balance of the first-order forces due to inertia between the needle bar and the crankshaft is possible. In this respect, no additional forces due to inertia occur at the needle bar.

In the search for the solution, it surprisingly turned out that such guide rods are also capable of absorbing dynamic forces due to inertia that result from a resulting horizontal motion of the needle bar, without these forces leading directly to a stimulation of vibrations.

To be able to make a flexible adjustment and needling with suitable horizontal stroke depending on the application and material properties of the fibrous webs, the variant of the present invention, in which the phase-adjustment means is designed in such a way that the eccentric shafts or crankshafts can be driven in phase with the phase angle $\phi=0°$ or optionally out of phase with the phase angle $\phi\neq0°$, is preferably used. Thus, the fibrous web can be needled exclusively with a vertical up and down motion of the needle bar. Depending on feed and material, besides the pure vertical motion of the needle bar, an additional superimposed horizontal motion can be produced by phase adjustment.

To adjust a phase difference in the crankshaft assembly, the phase-adjustment means is preferably formed by an adjusting gear and an adjusting actuator interacting with the adjusting gear or by an adjusting mechanism, wherein, the adjusting gear is coupled with one of the eccentric shafts or one of the crankshafts.

For this purpose, the adjusting gear has a displaceable actuating shaft and a gear pair with a helical gearing, wherein an adjusting path adjusted by the adjusting actuator or the adjusting mechanism at the actuating shaft can be converted by the gear pair into an adjusting angle. Phase adjustments can thus be made in the crankshaft assembly both in the inoperative state and during the operation.

To change the phase position of one of the eccentric shafts or one of the crankshafts directly, one of the gears of the gear pair is preferably arranged rigidly on the circumference of the eccentric shaft or of the crankshaft and the other gear is held rigidly on the circumference of the actuating shaft. The actuating shaft is held displaceably parallel to the eccentric shaft or crankshaft, so that a phase angle proportionally dependent on the adjustment path is adjusted at the eccentric shaft.

According to a variant of the present invention, the adjusting gear can be advantageously integrated as a gearing in the crankshaft assembly as well, such that the actuating shaft is formed by means of a displaceable gear. In this case, the gear shaft is arranged via a plurality of gear pairs with a helical gearing between two drive shafts, such that a double adjusting angle is produced when adjusting the gear shaft, which is transmitted via the drive shafts directly to the eccentric shafts or crankshafts. In this case, the gearing can also preferably be prearranged as an adjusting unit of a crankshaft unit, by means of which a plurality of connecting rods are driven.

To be able to make fine adjustments during the operation, a position indicator, which is coupled with a control means of the phase-adjustment means, is assigned to the adjusting actuator according to a preferred variant of the present invention. Exact machine adjustments can be made with this.

To drive both eccentric shafts or crankshafts, the variant of the present invention is used, in which the crankshaft assembly has a drive motor and the gearing, wherein both eccentric shafts or both crankshafts are coupled with one another by means of the gearing in such a way that both eccentric shafts or both crankshafts can be driven in opposite directions.

In order to make possible meshing with the crankshaft assembly for the purpose of interrupting the process, the variant of the present invention, in which the drive motor is connected directly to one of the drive shafts of the gearing or to one of the crankshafts and in which a braking means is assigned to the other drive shaft or to the other crankshaft, is especially advantageous. The entire crankshaft assembly can thus be safely kept stopped during an interruption of the process after switching off the drive motor.

However, there is basically also the possibility that a phase adjustment can be made at each of the eccentric shafts or crankshafts. For this purpose, the phase-adjustment means has two adjusting actuators with assigned adjusting gears.

To increase the mobility further for making defined guide paths at the needle bar, the guide rod or guide rods is/are preferably connected to the machine frame via a coupling kinematics according to an advantageous variant. Thus, depending on the formation of the coupling kinematics, additional mobilities can be generated at the guide rod and at the bar carrier. For further explanation of the present invention, some exemplary embodiments are described below with reference to the attached figures.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
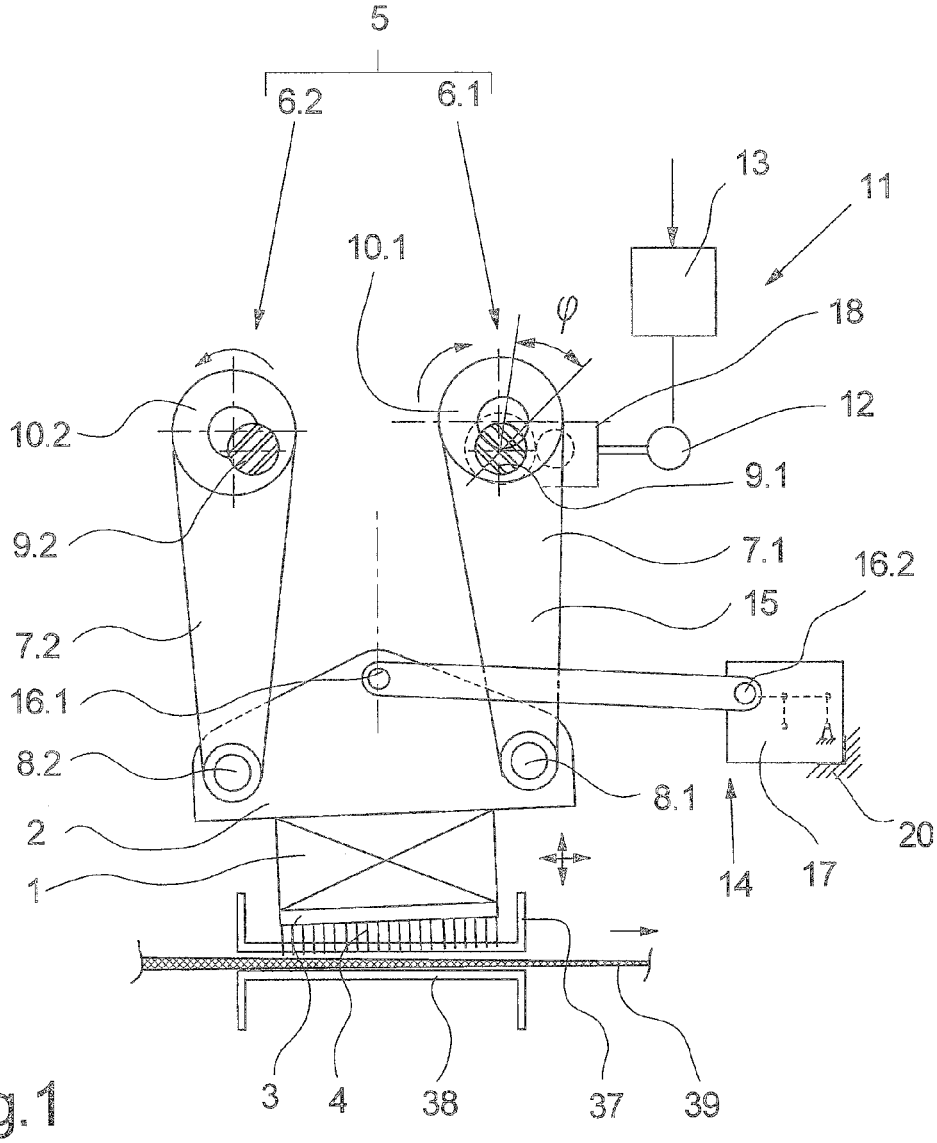
FIG. 1 is a schematic lateral view of a first exemplary embodiment of the device according to the present invention.

Referring to the drawings in particular, FIG. 1 schematically shows a first exemplary embodiment of the device according to the present invention for needling a fibrous web. The exemplary embodiment of the device according to the present invention according to FIG. 1 shows a bar carrier 2, which holds a needle bar 1 on its underside. The needle bar 1 carries on its underside a needle board 3 with a plurality of needles 4. A bed plate 38 and a stripper 37 are assigned to the needle board 3 with the needles 4, wherein a fibrous web 39 is guided with essentially constant feed rate between the bed plate 38 and stripper 37. The direction of motion of the fibrous web 39 is hereby identified by an arrow.

A crankshaft assembly 5 acts on the bar carrier 2. The crankshaft assembly 5 is formed by means of two crank drives 6.1 and 6.2 which are arranged parallel next to one another. The crank drives 6.1 and 6.2 have two crankshafts 9.1 and 9.2 arranged parallel next to one another, which are arranged above the bar carrier 2. Each of the crankshafts 9.1 and 9.2 has at least one eccentric section for receiving at least one connecting rod. FIG. 1 shows the connection rods 7.1 and 7.2 arranged at the bar carrier 2, which are held at the crankshafts 9.1 and 9.2 with their connecting rod heads 10.1 and 10.2. The connecting rods 7.1 and 7.2 are connected, with their opposite ends, by means of two connecting swivel joints 8.1 and 8.2 to the bar barrier 2. The crank drive 6.1, the crankshaft 9.1, with the connecting rod 7.1 and the crank drive 6.2, the crankshaft 9.2 with the connecting rod 7.2 lead the bar carrier 2 into an oscillating motion.

A phase-adjustment means 11 is assigned to the crankshaft 9.1. The phase-adjustment means 11 has an adjusting gear 18 and an adjusting actuator 12 interacting with the adjusting gear. The adjusting gear is coupled with the crankshaft 9.1 for adjusting a phase angle $\phi$. A control means 13, which is connected to adjusting actuator 12, is provided for adjusting and activating. The adjusting actuator 12 can be activated via the control means 13 in order to rotate the crankshaft 9.1 in its position. The phase position between the two crankshafts 9.1 and 9.2 can thus be adjusted. Besides the pure vertical up and down motion of the needle bar 1, a superimposed horizontal motion can as a result be performed at the bar carrier 2. Thus, a nearly vertical up and down motion is performed when the crankshafts 9.1 and 9.2 are in phase and are running synchronously. If the crankshafts 9.1 and 9.2 are out of phase, an oblique setting, which generates a motion component directed in the direction of motion of the fibrous web 27 in case of translatory motion, is initiated via the connecting rods 7.1 and 7.2 at the bar carrier 2. The size of the phase adjustment between the crankshafts 9.1 and 9.2 determines a stroke length of the horizontal motion. The stroke of the horizontal motion can be continuously adjusted via the phase angle $\phi$ of the crankshaft 9.1. The phase angle is adjusted here by means of the phase-adjustment means 11 in an angle range of 0-30° depending on the desired stroke length.

To guide the motion of the bar carrier 2, a guide means 14 is provided, which, in this exemplary embodiment, is formed by a guide rod 15, which is connected via a first swivel joint 16.1 to the bar carrier 2 and via a second swivel joint 16.2 to a coupling kinematics 17. The swivel joint 16.1 at the bar carrier 2 is connected in the middle of the bar, wherein the guide rod 15 is essentially directed horizontally. Thus, the forces due to inertia occurring in a state of out of phase operation are absorbed at the bar carrier 2 by pushing and pulling forces at the guide rod 15. The coupling kinematics 17 arranged between the second swivel joint 16.2 of the guide rod 15 and a machine frame 20 is not explained in detail here and may have one or more gear members to support the guide rod 15 against the machine frame and to make possible additional freedoms of motion in the up and down guiding of the bar carrier at the guide rod 15.

The exemplary embodiment shown in FIG. 1 is shown in an operating state, in which crankshafts 9.1 and 9.2 are driven in opposite directions synchronously. Here, crankshaft 9.1 has a phase angle $\phi \neq 0$, such that, besides the pure vertical up and down motion, a superimposed horizontal motion is initiated at the bar carrier 2.

Figure 2:
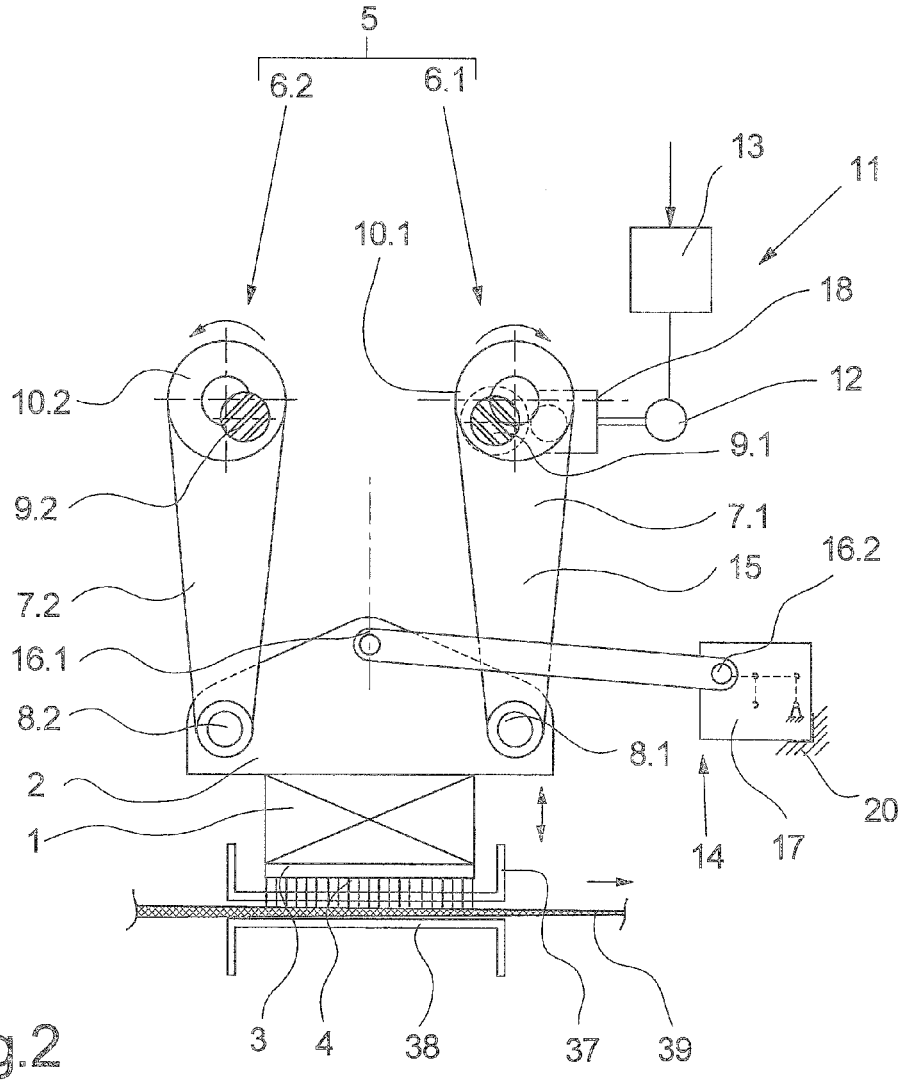
FIG. 2 is a schematic lateral view of the exemplary embodiment of FIG. 1 in changed operating state.

FIG. 2 shows the exemplary embodiment of FIG. 1 in an operating state, in which the crankshaft assembly 5 is operated in synchronous opposite direction with in-phase crankshafts 9.1 and 9.2. In this state, the phase angle $\phi=0$ is adjusted by the phase-adjustment means 11 at crankshaft 9.1. The crank drives 6.1 and 6.2 run in phase, such that the bar carrier 2 performs exclusively a vertical up and down motion. In this respect, the device according to the present invention can be used flexibly to needle fibrous webs.

Figure 3:
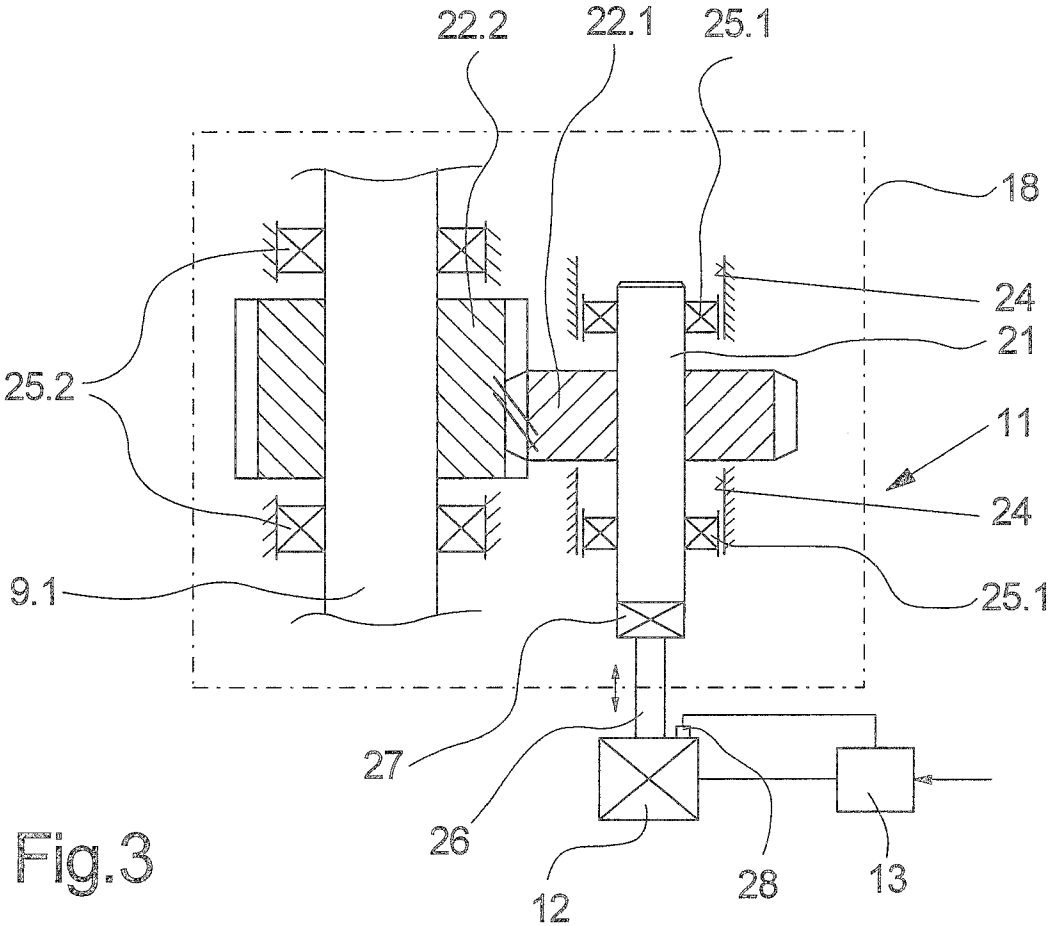
FIG. 3 is a schematic cross-sectional view of a first exemplary embodiment of a phase-adjustment means.

FIG. 3 shows a first exemplary embodiment of a phase-adjustment means 11, as it could be used, for example, in the exemplary embodiment according to FIG. 1. The phase-adjustment means 11 has the adjusting gear 18 and the adjusting actuator 12. In this exemplary embodiment, the adjusting gear 18 is formed by an actuating shaft 21, which is rotatably mounted by a mounting means 25.1. The actuating shaft 21 and the mounting means 25.1 are held within a housing in a push guide 24 and can be displaced back and forth in the axial direction of the actuating shaft 21.

The actuating shaft 21 is connected to the crankshaft 9.1 via a gear pair of the helical-cut gears 22.1 and 22.2. For this purpose, the crankshaft 9.1 has on the circumference the gear 22.2 connected to crankshaft 9.1. Gear 22.2 meshes with gear 22.1, since it is rigidly connected to the actuating shaft 21. Helical-cut gear 22.1 has a lower tooth width than helical-cut gear 22.2 on the circumference of the crankshaft 9.1.

Crankshaft 9.1 is rotatably mounted in a housing (not shown) and coupled with a drive (not shown here).

The adjusting actuator 12, which is coupled via a rod 26 to a free end of the actuating shaft 21 by a rotary connection 27, is provided for displacing the actuating shaft 21. The rotary connection 27 makes possible a free rotation of the actuating shaft 21 opposite the rod of the adjusting actuator 12.

A position indicator 28, which is connected to the control means 13, is assigned to the adjusting actuator 12. The position indicator 28 detects the instantaneous position of the rod 26 and thus the adjusting path of the actuating shaft 21. Incremental or distance indicators which sit on the adjusting actuator may be used as a position indicator 28.

For adjusting a phase angle $\phi$ at the crankshaft 9.1, the actuating shaft 21 of the push guide 24 is displaced via the adjusting actuator 12. Here, the relative position between the gears 22.1 and 22.2 is displaced, such that the adjusting path of actuating shaft 21 is converted via the helical gearing of the gears 22.1 and 22.2 in an angle of rotation at the crankshaft 9.1.

The exemplary embodiment of the phase-adjustment means 11 shown in FIG. 3 has the special advantage that the adjustment of the phase position of the crankshaft 9.1 is possible in the operating state as well. During operation, the crankshaft is driven and the gear 22.2 rotates with the crankshaft 9.1. The rotary motion is absorbed by the gear 22.1 and the actuating shaft 21 rotates along with the crankshaft 9.1 corresponding to the gearing. Independently of the rotary motion of the actuating shaft 21, this shaft 21 can be moved back and forth in the push guide 24 by the adjusting actuator 12.

Figure 4:
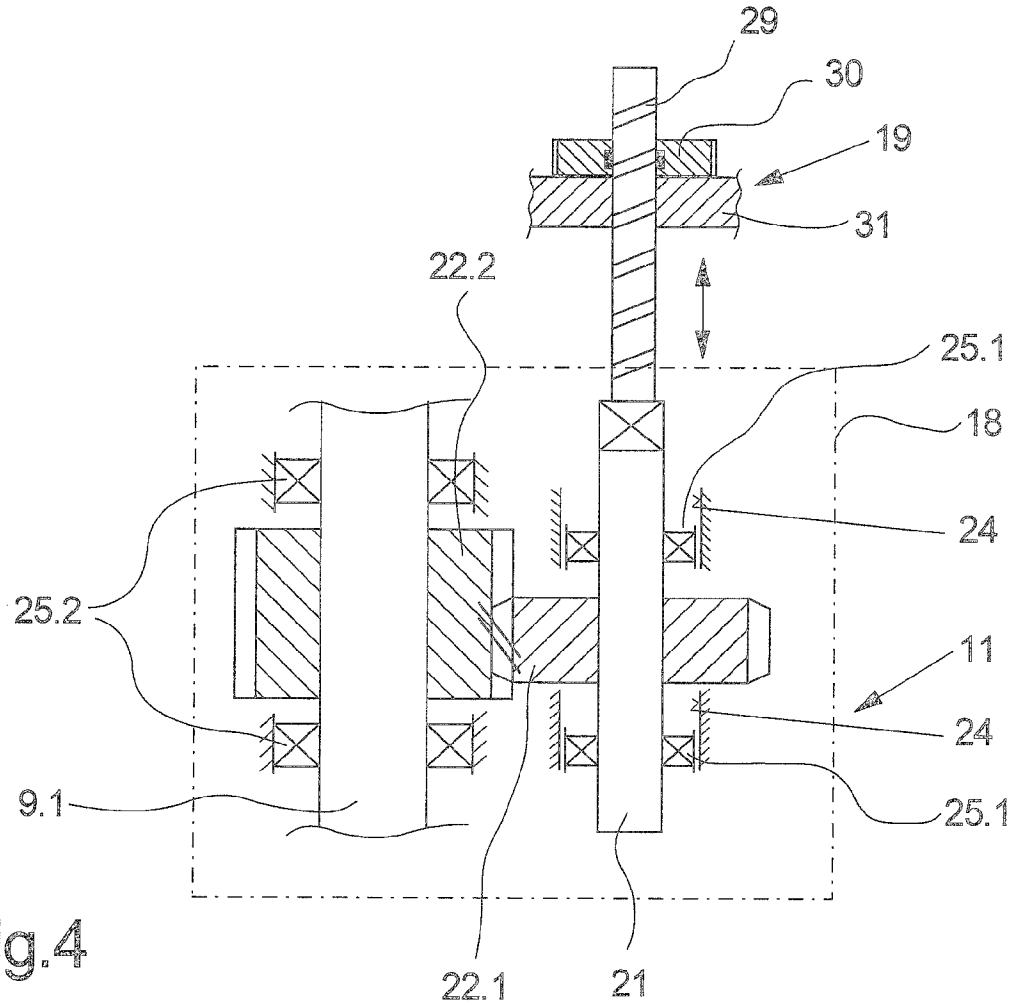
FIG. 4 is a schematic cross-sectional view of another exemplary embodiment of the phase-adjustment means.

However, the exemplary embodiment of the phase-adjustment means shown in FIG. 3 can also be advantageously combined with an adjusting mechanism. For this purpose, FIG. 4 shows an exemplary embodiment, in which the adjusting gear 18 is identical to the exemplary embodiment according to FIG. 3, so that at this point only the differences are explained and otherwise reference is made to the above-mentioned description.

For adjusting the actuating shaft 21 of the push guide 24, the adjusting mechanism 19 is formed by a spindle 29 and a spindle nut 30. The spindle 29 is coupled with the actuating shaft 21 via a rotary connection 27. The spindle nut 30 is guided on the circumference of the spindle 29 and is supported at the housing wall 31 of a housing. By rotating the spindle nut 30, spindle 29 can be adjusted parallel to the crankshaft 9.1 depending on the direction of rotation of the spindle nut 30, such that the actuating shaft 21 performs a corresponding motion in the axial direction. Thus, a manual adjustment of the phase angle can also be made at the crankshaft 9.1 of the exemplary embodiment according to FIG. 1.

Figure 5:
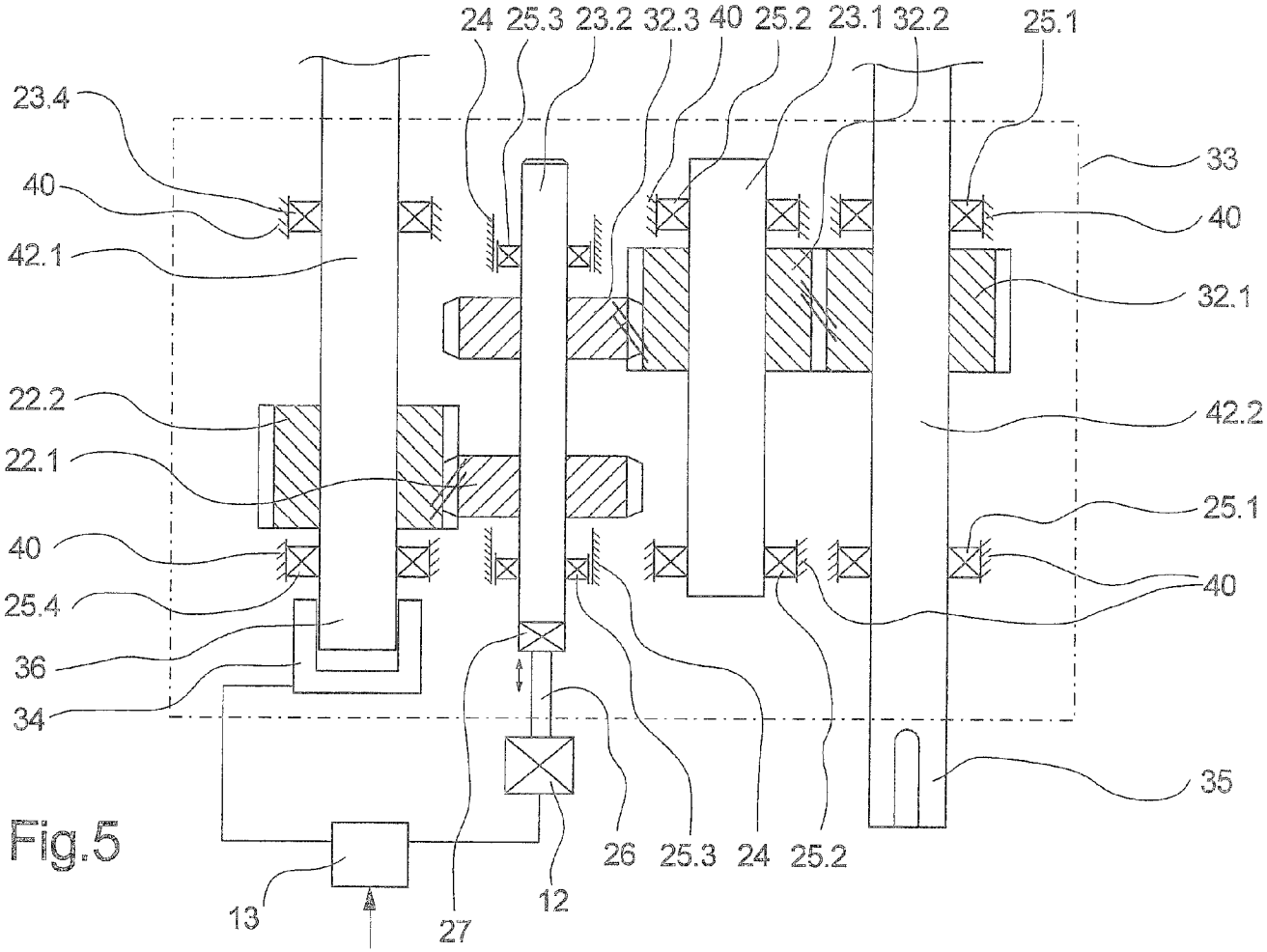
FIG. 5 is a schematic cross-sectional view of another exemplary embodiment of the phase-adjustment means.

FIG. 5 shows another exemplary embodiment of the phase-adjustment means, as it would be possible in a crankshaft assembly for driving two crankshafts or two eccentric shafts. For this purpose, two drive shafts 42.1 and 42.2, which may, as an alternative, also be designed directly as crankshafts or eccentric shafts, are connected to one another by means of a gearing 33. Via the coupling by the gearing 33, it is possible to drive the crankshaft assembly by means of a drive motor. For this purpose, the drive shaft 42.2 has a drive end 35, at which a drive motor (not shown here) can be coupled directly or by means of, e.g., belts. The drive shaft 42.2 is mounted rotatably in a housing 40 by means of a first mounting means 25.1. A gear 32.1, which meshes with a second gear 32.2, is arranged on the circumference of the drive shaft 42.2 for torque transmission. The gear 32.2 is held on the circumference of a rotatably mounted gear shaft 23.1. The gear shaft 23.1 is mounted in the housing 40 via a second mounting means 25.2.

For further torque transmission, a second gear shaft 23.2 is provided, which carries two gears 32.3 and 22.1 arranged at a distance to one another on its circumference. The gear 32.3 meshes with the gear 32.2 held at the first gear shaft 23.1. In this case, the gear pairs of the gears 32.1, 32.2 and 32.3 are each formed by helical-cut gears.

The second gear 22.1 held at a distance to the gear 32.3 at the gear shaft 23.2 likewise has a helical gearing and meshes with a gear 22.2 on the circumference of the drive shaft 42.1. For this purpose, the drive shaft 42.1 is mounted in the housing 40 via a fourth mounting means 25.4.

The gear shaft 23.2 is held within the housing 40 by means of a push guide 24 with its mounting means 2.3 displaceable in the housing 40. An adjusting actuator 12, which is coupled via a rotary connection 27 at the free end of the gear shaft 23, acts on a free end of the gear shaft 23.2. The function of the adjusting actuator 12 as well as of the gear shaft 23.2 is identical to the exemplary embodiment of the phase-adjustment means in FIG. 3. Here, adjusting actuator 12 is changed via the adjusting path of the gear shaft 23.2 in the position of the gears 22.1 and 32.3. The crankshaft 9.1 is rotated by the helical gearing selected at the gears 22.2 and 22.1, such that a certain phase angle $\phi$ is adjusted at the crankshaft 9.1 depending on the adjusting path of the gear shaft 23.2. The change in position of the gear 32.3 relative to the gear 32.2 leads here to an identical adjustment of the angle position of the gear shaft 23.1 and thus of drive shaft 42.2. The gears 22.1 and 32.3 at the gear shaft 23.2 have an opposing helical gearing, such that a double adjusting angle is adjusted. Drive shaft 42.1 and drive shaft 42.2 are each adjusted by the phase angle $\phi$, such that a double adjusting angle is adjusted by displacing gear shaft 23.2. Thus, drive shaft 42.1 could be adjusted by the phase angle $\phi=10°$ and drive shaft 42.2 by the phase angle $\phi=-10°$, so that a total adjusting angle of 20° arises.

Drive shaft 42.1 has a free braking end 36, at which a braking means 34 is arranged. The braking means 34 is connected to a control device (not shown here), such that during an interruption of the process, the crankshaft assembly can be blocked after the drive motor brakes the drive shaft 42.1 and thus the entire crankshaft assembly can be held at a stop with certainty.

In the gearing 33 shown in FIG. 5, the opposing ends of the drive shafts 42.1 and 42.2, which are not shown in detail here, are connected directly to the crankshafts 9.1 and 9.2 or to eccentric shafts. The connections between the drive shafts 42.1 and 42.2 and the assigned crankshafts take place preferably via coupling means that guarantee a nonslip rotary transmission. However, the drive shafts 42.1 and 42.2 shown in the exemplary embodiment might also, as an alternative, be designed directly as crankshafts or eccentric shafts to drive directly a plurality of connecting rods with the drive ends.

Figure 6:
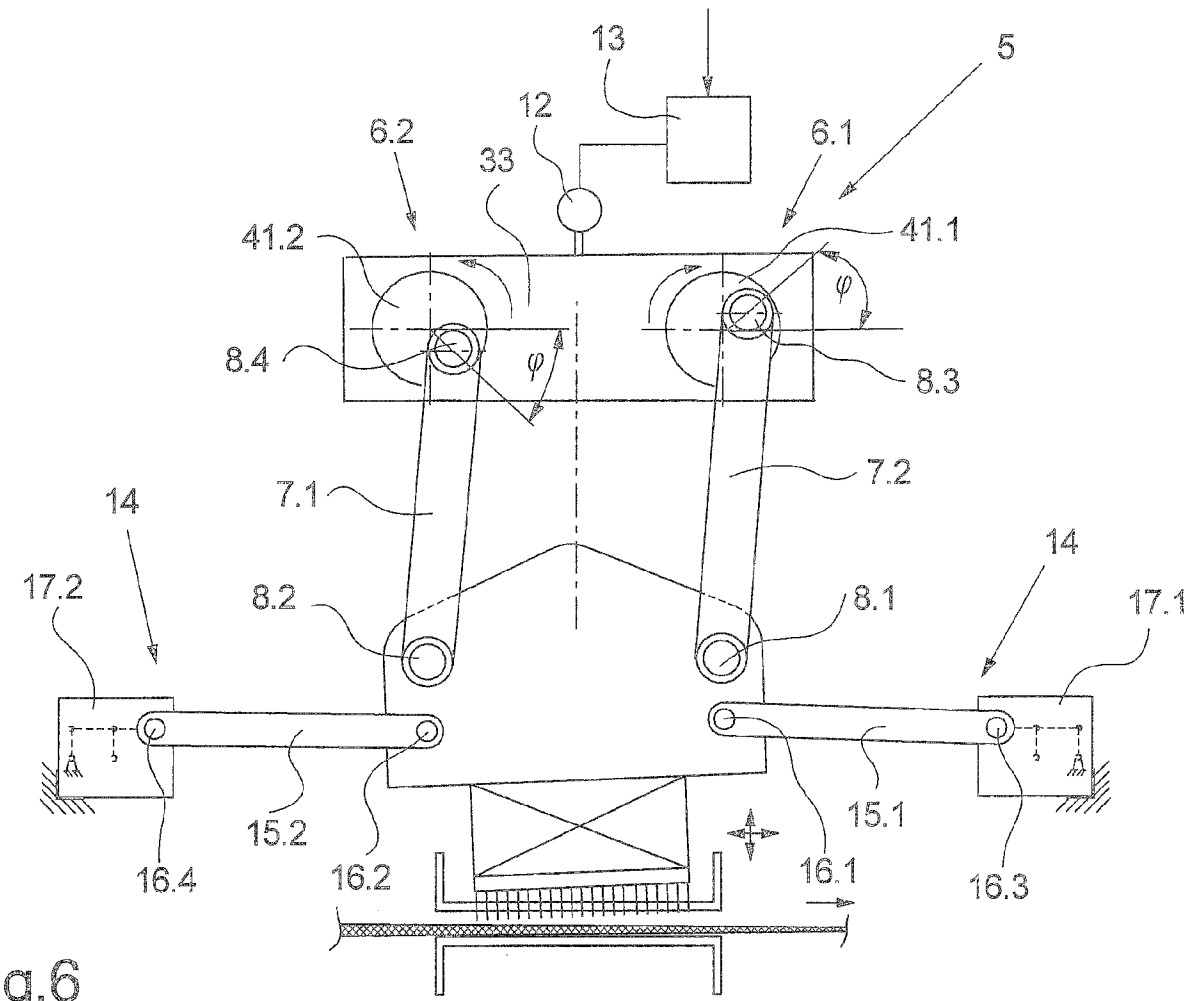
FIG. 6 is a schematic lateral view of another exemplary embodiment of the device according to the present invention.

FIG. 6 shows an exemplary embodiment of the device according to the present invention, in which the crank drives 6.1 and 6.2 each have a driven eccentric shaft 41.1 and 41.2. The crankshaft assembly 5 for driving the eccentric shafts 41.1 and 41.2 has a gearing 33 and a drive motor (not shown here). According to the exemplary embodiment according to FIG. 5, the gearing 33 may be designed, such that an adjusting actuator 12 is assigned to the gearing 33 to be able to make a phase adjustment between the eccentric shafts 41.1 and 41.2. In this respect, reference is made to the above-mentioned exemplary embodiment of the phase-adjustment means according to FIG. 5. The eccentric shafts 41.1 and 41.2 are connected via connecting swivel joints after 8.3 and 8.4 to the connecting rods 7.1 and 7.2, which hold at the opposing free ends of the bar carrier 2. For this purpose, the connecting rods 7.1 and 7.2 are arranged with the connecting swivel joints 8.1 and 8.2 at the bar carrier 2. The bar carrier 2 is designed on its underside identical to the exemplary embodiment according to FIG. 1, such that at this point no further explanation is given and reference is made to the description according to FIG. 1.

The guide means 14 is formed in this exemplary embodiment by two guide rods 15.1 and 15.2. The guide rods 15.1 and 15.2 are arranged on both sides of the bar carrier 2 and each is connected to the bar carrier via a swivel joint 16.1 and 16.2. At the opposing ends, the guide rods 15.1 and 15.2 are connected via swivel joints 16.3 and 16.4 to two preferably identically designed coupling kinematics 17.1 and 17.2, which are held at the machine frame 20. The coupling kinematics 17.1 and 17.2 are preferably identically designed, such that the bar carrier 2 is guided through the guide rods 15.1 and 15.2 equally on both sides. In this exemplary embodiment, the dynamic forces due to inertia can advantageously be absorbed distributed on two opposing guide rods, wherein these forces are essentially transmitted to the coupling kinematics 17.1 and 17.2 by pulling and pushing forces in the guide rods 15.1 and 15.2.

In the exemplary embodiments of the device according to the present invention shown, the phase-adjustment means was used in each for adjusting a phase angle at one of the crankshafts or eccentric shafts. However, it is also basically possible to form the phase-adjustment means by means of two adjusting actuators and two adjusting gears, each of which acts on one of the crankshafts or eccentric shafts. Thus, for example, the exemplary embodiment shown in FIG. 2 of the phase-adjustment means can be expanded in such a way that at each of the crankshafts, an actuating shaft is connected via a gear pair to the respective crankshafts. However, it should be noted in all exemplary embodiments of the phase-adjustment means that the respective position remains fixed during operation. The adjustment of the crankshafts and of the eccentric shafts can take place both during operation with rotating shafts or when stopped with fixed shafts. Of course, alternative adjusting mechanisms with mechanical or hydraulic gears may also be used to be able to adjust a corresponding phase position at the crankshafts and eccentric shafts.

The device for needling according to the present invention can thus be used in a flexible manner to be able to perform a needling with or without horizontal motion of the needles. The horizontal motion of the needle points is generated exclusively by tilting the bar carrier. With in-phase rotation of the crankshafts, a pure vertical motion of the needle points takes place, wherein the bar carrier is guided in both cases advantageously by one or more guide rods.

While specific embodiments of the invention have been shown and described in detail to illustrate the application of the principles of the invention, it will be understood that the invention may be embodied otherwise without departing from such principles.

The invention claimed is:

1. A device for needling a fibrous web, the device comprising:

an oscillating driven needle bar, which has on its underside a needle board with a plurality of needles;

a movable bar carrier for holding the needle bar;

a crankshaft assembly for the oscillating motion of the bar carrier, which has at least two connecting rods connected to the bar carrier and two driven eccentric shafts or two driven crankshafts, with a phase-adjustment means for adjusting a phase angle at one of the two eccentric shafts or at one of the two crankshafts; and a guide means acting on the bar carrier for guiding the needle bar during needle bar oscillating motion, the guide means comprising one or more guide rods, which are connected to the bar carrier by means of one or more swivel joints, wherein the driven needle bar is guided by the guide rod or guide rods at the phase angle adjusted by the phase-adjustment means in the angle range of 0° to 30°, wherein the phase-adjustment means comprises an adjusting gear and an adjusting actuator or an adjusting mechanism interacting with the adjusting gear, wherein the adjusting gear is coupled with one of the eccentric shafts or crankshafts, wherein the adjusting gear is formed by a displaceable actuating shaft and a gear pair with a gear having teeth that are not parallel to the axis of rotation, wherein an adjustment path adjusted by the adjusting actuator or by the adjusting mechanism at the actuating shaft is converted by the gear pair into an adjusting angle.

2. A device in accordance with claim 1, wherein the phase-adjustment means is designed in such a way that the eccentric shafts or crankshafts can be driven in phase with the phase angle $\phi=0°$ or optionally out of phase with the phase angle $\phi\#0°$.

3. A device in accordance with claim 1, wherein one of the gears of the gear pair is arranged rigidly on the circumference of a drive shaft or crankshaft and the other gear is arranged rigidly on the circumference of the actuating shaft, wherein the actuating shaft is held in a displaceable manner parallel to the drive shaft or crankshaft.

4. A device in accordance with claim 1, wherein the actuating shaft is formed by a displaceable gear shaft of a gearing of the crankshaft assembly, which gear shaft is coupled with a helical gearing with two drive shafts via a plurality of gear pairs, which drive shafts are connected to the eccentric shafts or crankshafts.

5. A device in accordance with claim 1, further comprising a position indicator, which is coupled with a control means of the phase-adjustment means, assigned to the adjusting actuator.

6. A device in accordance with claim 5, wherein the crankshafts are part of a crankshaft assembly that has a drive motor and the gear pair, wherein both eccentric shafts or crankshafts are coupled with one another by means of the gear pair in such a way that both eccentric shafts or both crankshafts can be driven in opposite directions.

7. A device in accordance with claim 6, wherein the drive motor is connected to one of the eccentric shafts or directly to one of the crankshafts, and further comprising a braking means assigned to the other eccentric shaft or to the other crankshaft.

8. A device in accordance with claim 1, wherein the phase-adjustment means has two adjusting actuators with assigned adjusting gears, which are assigned to the eccentric shafts or crankshafts and which are controllable independently of one another via a control means.

9. A device in accordance with claim 1, wherein the swivel joint of the guide rod is arranged in the middle area of the bar carrier, and that the opposite end of the guide rod is connected to a machine frame via a coupling kinematics.

10. A device in accordance with claim 1, wherein the guide means comprising a plurality of guide rods and the guide rods are arranged on two sides of the bar carrier and are supported on a machine frame via a coupling kinematics assigned to each of the guide rods.

11. A device for needling a fibrous web, the device comprising:

a needle bar with a needle board at an underside of said needle bar, said needle board having a plurality of needles;

a movable bar carrier holding said needle bar;

a crankshaft assembly connected to said bar carrier and imparting an oscillating motion to said bar carrier, said crankshaft assembly comprising connecting rods connected to said bar carrier, one of driven eccentric shafts and driven crankshafts and a phase-adjustment arrangement adjusting a phase angle of one of said eccentric shafts relative to another of said eccentric shafts or for adjusting a phase angle of one of said crankshafts relative to another of said crankshafts in an angle range of 0° to 30°; and a guide acting on said bar carrier and guiding said needle bar during said an oscillating motion, said guide comprising a guide rod and a swivel joint, said guide rod being connected to said bar carrier by said swivel joint with said needle bar guided by said guide in the phase angle range of 0° to 30°, wherein:

said phase-adjustment arrangement adjusts said eccentric shafts or crankshafts to be driven in phase with the phase angle $\phi=0°$ or out of phase with the phase angle $\phi\neq0°$;

said phase-adjustment arrangement comprises an adjusting gear and an adjusting actuator or an adjusting mechanism that interacts with said adjusting gear and is associated with said adjusting gear, wherein said adjusting gear is coupled with one of said eccentric shafts or crankshafts; and said adjusting gear comprises a displaceable actuating shaft and a gear pair with a helical gearing, wherein an adjustment path adjusted by said adjusting actuator or by said adjusting mechanism at said actuating shaft is converted by said gear pair into an adjusting angle.

12. A device in accordance with claim 11, wherein one of said gears of said gear pair is arranged rigidly on a circumference of a drive shaft or crankshaft and the other gear is arranged rigidly on a circumference of the actuating shaft, wherein the actuating shaft is held in a displaceable manner parallel to the drive shaft or crankshaft.

13. A device in accordance with claim 12, wherein said actuating shaft comprises a displaceable gear shaft of a gearing of said crankshaft assembly, said displaceable gear shaft being coupled with a helical gearing with two drive shafts via a plurality of gear pairs, said two drive shafts being connected to said eccentric shafts or crankshafts.

14. A device in accordance with claim 11, further comprising a phase-adjustment control wherein said phase-adjustment arrangement comprises two adjusting actuators, each assigned to adjusting gears, which are assigned to said eccentric shafts or crankshafts and which are controllable independently of one another via said phase-adjustment control.

15. A device in accordance with claim 11, further comprising: a coupling kinematics wherein said swivel joint connects said guide rod to a middle area of said bar carrier and an opposite end of said guide rod is connected to a machine frame via said coupling kinematics.

* * * * *